United States Patent [19]

Lazar

[11] 4,302,040

[45] Nov. 24, 1981

[54] WATER JET CLEANING DEVICE

[76] Inventor: Raymond J. Lazar, 110 Jeepers Dr., Naples, Fla. 33942

[21] Appl. No.: 189,388

[22] Filed: Sep. 19, 1980

[51] Int. Cl.[3] ..... A47F 13/06

[52] U.S. Cl. ..... 294/19 R; 239/287

[58] Field of Search ..... 294/1 R, 15, 16, 1 BA, 294/1 DB, 19 R; 239/287, 288, 104, 106; 15/236 R

[56] References Cited

U.S. PATENT DOCUMENTS

| | | | |
|---|---|---|---|
| 2,233,968 | 3/1941 | White . | |
| 2,589,020 | 3/1952 | North, Jr. . | |
| 2,841,923 | 7/1958 | Dickison . | |
| 3,041,655 | 7/1962 | Extler | 294/19 R |
| 3,313,353 | 4/1967 | Williamson et al. . | |
| 3,422,828 | 1/1969 | Dommer . | |
| 3,740,086 | 6/1973 | Rossitto . | |
| 3,807,632 | 4/1974 | Johnson, Jr. . | |

FOREIGN PATENT DOCUMENTS

| | | | |
|---|---|---|---|
| 1398142 | 3/1965 | France | 239/288 |

*Primary Examiner*—James B. Marbert
*Attorney, Agent, or Firm*—David H. Semmes

[57] ABSTRACT

A device for in situ churning and removal of animal manure by water jet action. Particularly, a tubular handle fitting for a garden hose. The tubular handle includes an inverted open-ended cup at its lower end with a transverse perforated plate positioned in the cup, such that the flowing water is jetted onto the manure so as to churn the manure forcing it into the lawn or ground surface and, thereby, eliminating the conventional necessity for removal and separate disposal of the manure.

2 Claims, 5 Drawing Figures

WATER JET CLEANING DEVICE

BACKGROUND OF THE INVENTION

1. Field of the Invention

Water jet cleaning devices, particularly a water jet device for dissolving animal manure, such that it may be absorbed without removal into a lawn or ground surface. Due to the increasing canine population, there has been recent attention to manure or excreta removal devices. Notably, the "Pooper Scooper" has been employed in metropolitan areas. Various other pick-up devices have been devised.

2. Description of the Prior Art

| | |
|---|---|
| WHITE | 2,233,968 |
| NORTH | 2,589,020 |
| DICKISON | 2,841,923 |
| WILLIAMSON et al. | 3,313,353 |
| DOMMER | 3,442,828 |
| ROSSITTO | 3,740,086 |
| JOHNSON | 3,807,632 |

The ROSSITO pick-up device includes an inverted cup-like cavity having a plurality of radial ribs which are used to engage the manure; hence, a cover is placed upon the open end for removal and disposal.

WHITE shows the employment of a perforated plate for dispensing fluids. NORTH, DICKISON, WILLIAMSON et al., JOHNSON and DOMMER show the use of hoods to control the spray of a jet stream. JOHNSON teaches, also, the use of a cavitating fluid jet to erode solid.

ROSSITTO is the single device of the "Pooper Scooper" type. However, there is no suggestion of employing a hydraulic jet with the ROSSITTO device.

SUMMARY OF THE INVENTION

According to the present invention, the manure is dissolved and churned by means of a water jet so as to be forced into the ground, eliminating the necessity for removal. A pick-up device includes an elongated tubular handle fitted at its top with a garden hose fitting and at its bottom end within an inverted open-ended cup. The inverted cup includes a transverse perforated plate so as to divert the flowing water stream from a garden hose into a plurality of high pressure jets, capable of churning the manure and forcing the manure particles into the lawn or ground. An on-off valve may be rotatably supported in the handle adjacent the garden hose fitting.

DESCRIPTION OF THE PREFERRED EMBODIMENTS

Figure 1:
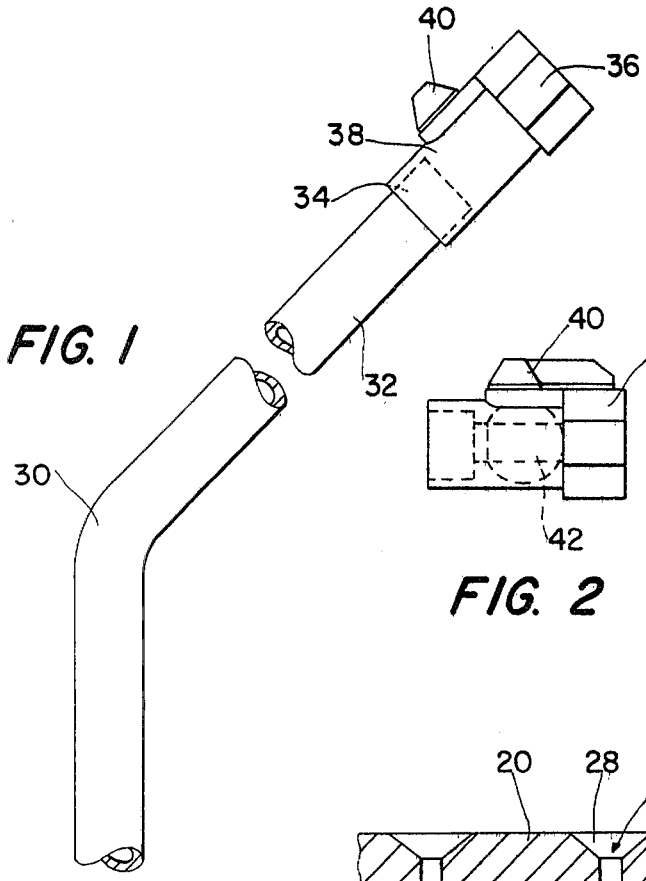
FIG. 1 is a front elevation, partially in section, showing the elongated tubular handle, communicating with the inverted cup at its lower end.

In FIG. 1 there is illustrated a water jet cleaning device 10 including an elongated tubular handle 12, having an inner water flowing channel 14. The tubular handle 12 at its bottom end is fitted complementally within an axially extending collar 44 extending upwardly from inverted open-ended cup 16. A reinforcing annular collar 18 may be fitted both over the tubular handle 12 and the axially extending collar 44. The open-ended cup includes a transverse perforated plate 20, having a series of radially extending perforations 22.

Figure 5:
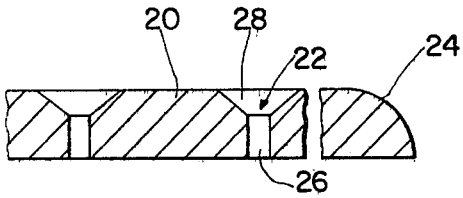
FIG. 5 is a fragmentary vertical section of the perforated plate, showing the individual perforations having a wide water receiving end and a narrow discharge passage extending through the plate.
Figure 4:
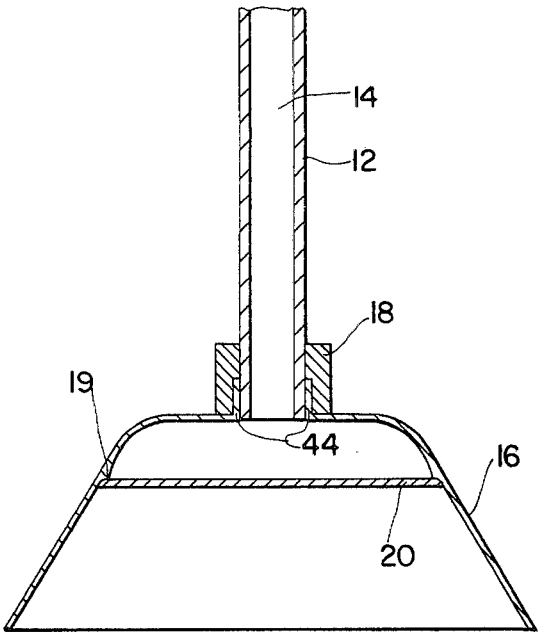
FIG. 4 is a plan view of the perforated plate which is fitted transversely within the inverted cup.
Figure 4:
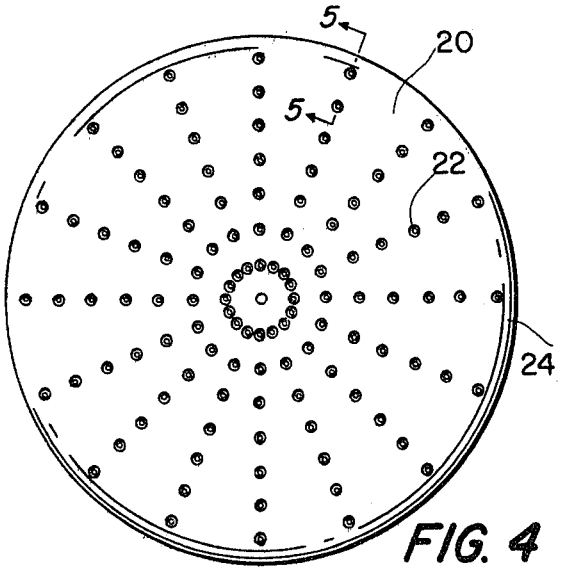

As illustrated in FIG. 5, the individual perforations 22 include a wide water receiving area 28 defined in the top of perforated plate 20 and a narrow exit channel 26 extending through the plate and into the open end of cup 16.

Figure 2:
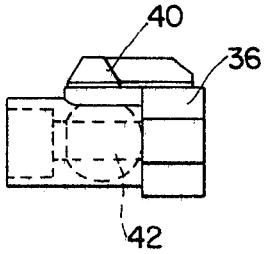
FIG. 2 is a plan view of the shut-off valve in open position.
Figure 3:
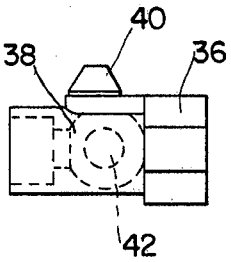
FIG. 3 is a plan view of the shut-off valve in closed position.

The tubular handle 12 may be bent or angled as at 30 to minimize height distortion. As illustrated in FIG. 1, the tubular handle 12 has been angled at 45 degrees. However, a 30 degree angle may suffice. At the tubular handle 12 upper end, a valve housing 38 may be cemented thereto. The valve housing may have a conventional garden hose fitting 36 at its outer end and include a pivoted valve member 38 having an exteriorly protruding adjusting knob 40 and a water flowing channel 42 which communicates with the tubular handle channel 14. In FIG. 2 valve 38 is shown in open position. In FIG. 3 valve 38 is shown in closed position.

As illustrated in FIGS. 1 and 5, perforated plate 20 includes an upper rounded or bevel edge 24 for complemental engagement with inner shoulder 17 within the inverted cup. Thus, perforated plate 20 may be cemented or otherwise firmly secured within the inverted cup 16.

According to the present invention, canine manure may be churned, thusly, by water jet action and, thence, forced into the lawn or ground without creating holes or otherwise disturbing the lawn. There is eliminated the requirement for removal of the manure with consequent mess. The churning and water jet action dissipates manure such that its presence is not noticeable and both flies and odor are eliminated.

Manifestly, various types of perforated plates, water valves and the like, may be employed without departing from the spirit of the invention.

I claim:

1. A water jet cleaning device comprising:

A. an elongated tubular handle having a garden hose inlet fitting with rotatable valve at its upper end;

B. an inverted transparent cup secured at said tubular handle bottom end with the bottom end extending into an axial hole defined in said cup, said cup being supported upon said tubular end such that the open cup end is presented outwardly of said tubular handle, said cup further including:

i. an annular collar projecting axially from the inverted bottom thereof, so as to engage complementally the exterior surface of said tube end; and ii. an inner shoulder;

C. a perforated plate supported as a transverse platform within said cup and complementally engaging said inner shoulder, so as to intersect water flowing through said handle and outwardly of said cup; and D. a reinforcing collar fitted over said tubular handle and said annular collar, such that the reinforcing collar bottom complementally engages the inverted cup bottom, said annular collar and said tubular handle.

2. A water jet cleaning device as in claim 1, said perforated plate including a radially arranged series of discrete perforations, each perforation having a wide water receiving area defined within the top surface of said plate and a narrow discharge exit extending through the bottom of said plate.

* * * * *